US008250688B2

(12) United States Patent
Alegria Mendez et al.

(10) Patent No.: US 8,250,688 B2
(45) Date of Patent: Aug. 28, 2012

(54) BEDDING STRAIGHTENING MECHANISM

(76) Inventors: Jose Luis Alegria Mendez, Santiago (CL); Michelle Carla Danzinger Canata, Santiago (CL); Edson Concha Quechuyao, VIII Region (CL)

( * ) Notice: Subject to any disclaimer, the term of this patent is extended or adjusted under 35 U.S.C. 154(b) by 0 days.

(21) Appl. No.: 12/596,723

(22) PCT Filed: Apr. 23, 2008

(86) PCT No.: PCT/US2008/061320

§ 371 (c)(1),
(2), (4) Date: Oct. 18, 2010

(65) Prior Publication Data

US 2011/0308018 A1 Dec. 22, 2011

(30) Foreign Application Priority Data

Apr. 23, 2007 (CL) ..... 1154-2007

(51) Int. Cl.
*A47C 21/02* (2006.01)
*A47G 9/02* (2006.01)

(52) U.S. Cl. ..... 5/658; 5/488; 5/482

(58) Field of Classification Search ..... 5/488, 482, 5/494, 658

See application file for complete search history.

(56) References Cited

U.S. PATENT DOCUMENTS 3,895,404 A 7/1975 Wilson
4,959,877 A 10/1990 Covil
5,926,874 A 7/1999 Browder
2011/0308018 A1* 12/2011 Alegria Mendez et al. ..... 5/658

* cited by examiner

*Primary Examiner* — Robert G Santos
(74) *Attorney, Agent, or Firm* — Porzio, Bromberg & Newman, P.C.

(57) ABSTRACT

A bedding straightening system attached to a base of an ordinary bed, including a blanket air distributor, bottom sheet side air distributors, connectors, bottom sheet, top blanket and sheet. A series of ducts or hoses which carry the air expelled from the air compressor or air expelling turbine towards different outlet points are located around the perimeter of the bed and connected to the bedding by a blanket air distributor and bottom sheet side air distributors. The bedding includes at least one bottom sheet and one bedspread. The bottom sheet when inflated produces tension on the sheet structure causing the straightening thereof. Air outlets protrude outwardly from the base of the bed through hoses disposed beneath the bottom sheet in order to lift and ventilate the bottom sheet.

10 Claims, 13 Drawing Sheets

BEDDING STRAIGHTENING MECHANISM

CROSS REFERENCE TO RELATED APPLICATION

This is a National Stage of International Application No. PCT/US2008/061320, filed Apr. 23, 2008, which claims the benefit of Application No. 1154-2007, filed in Chile on Apr. 23, 2007, the disclosures of which Applications are incorporated by reference herein.

BACKGROUND OF THE INVENTION

1. Field of the Invention

Bedding straightening mechanism to be attached to the base of the bed, berth, hospital bed and the like, which acts as a bedding automatic straightening device.

2. Description of Related Art

Hospital beds that have air ducts to ventilate or warm up are well known. (For example, to ventilate or warm up immobilized patients), or to warm up the mattress. For hotel and home beds, there are folding beds or the ones which can be transformed into pieces of furniture such as an armchair or may be a wall folding bed. There are also inflatable mattresses for camping or swimming pool. (A47C: 21/00, 21/02, 21/04, 21/06, 23/047, 23/18, 27/18. B65G: 51/08).

SUMMARY OF THE INVENTION

The present invention relates to a device which enables the function of automatically unfolding and straightening bed clothing (especially designed); bottom sheet, top sheet, blanket, and bedspread. The core idea of this invention is: "the self-made bed", because it enables, through this device, the daily household chores of tidying up and straightening bed clothing to be carried out without the direct intervention of people.

To achieve this, a mechanism has been developed which can be adapted to any type of beds and that is based on an air distributing system generated by an air compressor; the air is distributed to different places through hoses.

This mechanism is divided into groups of objects: first, the objects that are disposed inside the bed's base, immediately attached to it or protruding from the edges thereof. This is a group of "fixed object". Second, there is a group of mobile objects; which are located outside of the bed and are adjustable, interchangeable and detachable objects.

The group of fixed objects basically consists of a mechanism comprising an air compressor or small size turbine, located inside a soundproof box, and a series of hoses which carry and distribute the air expelled from the compressor or turbine towards different outlet points strategically located around the perimeter of any base frame which supports the bed mattress. Those outlet points or air terminals are openings which will be used as a connection site between the base of the bed and bedding through pieces called "air distributors" in the case of the base and "air connectors" in the case of bedding items, which as mentioned before received the name of "group of mobile objects".

The mechanisms that perform bedding functions (mobile objects) comprise mainly air bags or chambers which are designed as bedding sewed integrated pieces (sheets, blankets and bedspread), which receive through their "air connectors", the air expelled from the compressor for their immediate filling, unfolding and performing. According with the specific functions, each of these parts are to be attached to the bed base, and the pieces called "air connectors" and "air distributors" are to be attached through Velcro tapes, pressure clasps and buttons.

For this invention the following has been designed and defined as bedding: a bedspread, a blanket, a top sheet and a bottom sheet.

The bedspread has been designed according to the structure of air bags and chambers disposed along the length and width thereof which receive the air expelled from the compressor through a group of "air connectors" and thus causing their expansion while straightening the bedspread (when it is folded or creased). These air chambers are empty spaces between semi impermeable fabric layers limited by seams with varying sizes and designs according to the desired style. With regard to the drawings in this project, these are represented by rectangular chambers since they are basic forms. This bedspread is attached from one of their ends to one of the fixed pieces called "central air distributor" by means of a Velcro tape system. Additionally, it has a snap or Velcro tape system along the edges of the bedspread which is used to attached one or more blankets and the top sheet. Once the mechanism is running, the bedspread is inflated with the air expelled from the compressor or turbine, thus causing the straightening and unfolding thereof along with the bedding attached to it.

The mechanism of functioning of both blankets and top sheet is based on a snap and Velcro tape system disposed along the edges and its purpose is to enable the bedspread to be attached, the bedspread being used as a guide to straighten and unfold bedding top items.

The basic design of the bottom sheet is similar to that of conventional bottom sheets, such as "up-side-down drawer" sheets; however, for this invention it has been designed with an inflatable band, or tubular air chamber which crosses both lateral sides plus the back side, through its lower edge and with a size smaller than each of the lateral sides. This inflatable tubular chamber has in each of its three sides small tubes used as "air connectors" with air outlets located at the base of the bed which are specially designed to fit with these connectors. The purpose of this system is that upon running the mechanism, the air is expelled by the compressor and the tubular chambers are inflated so that a tension on the sheet structure is produced causing the straightening thereof, therefore, requiring no human involvement.

This bottom sheet is attached to the bed by means of Velcro tapes or snaps.

The bottom sheet is involved in a second action; this is done trough a device (lateral air distributor) located at both lateral sides of the bed base, which consists of a small group of air outlets which slightly protrude outwardly from the base of the bed through small hoses disposed at an ascending angle. These hoses are located beneath the bottom sheet and their function is to blow upwards in order to lift and ventilate the bottom sheets, and thus, requiring no human involvement in this process either.

The invention will be more fully described by reference to the following drawings.

N° 1: Central air distributor for top sheet, blanket and bedspread.

N° 2: Lateral air distributors for bottom sheet.

N° 3: Soundproof box for compressor or turbine.

N° 4: Compressor or small turbine.

N° 5: Lateral air distribution ducts for bottom sheet.

N° 6: Central air distribution duct for top sheet, blanket and bedspread.

N° 7: Bottom sheet air chamber duct.

N° 8: Bottom sheet air chamber connector.

N° 9: Bottom sheet fastening Velcro.

N° 10: Fastening Velcro for top sheet, blankets and bedspread.

Figure 2:
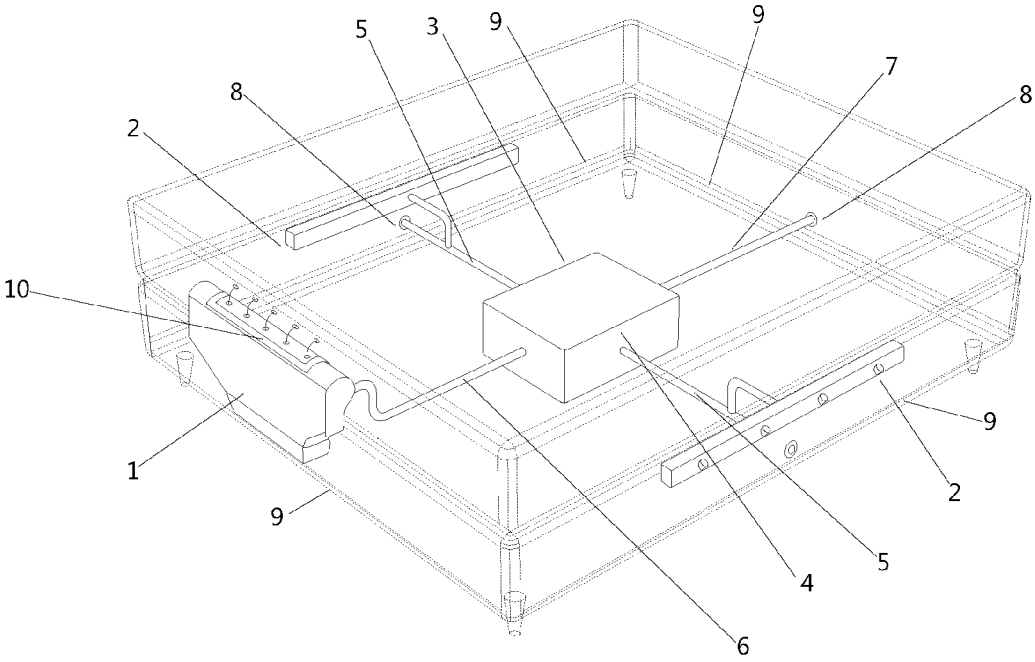

FIG. 2: Is the overall view from another perspective of a conventional bed equipped with the bedding straightening mechanism (Numbers=Draw. 1)

Figure 3:
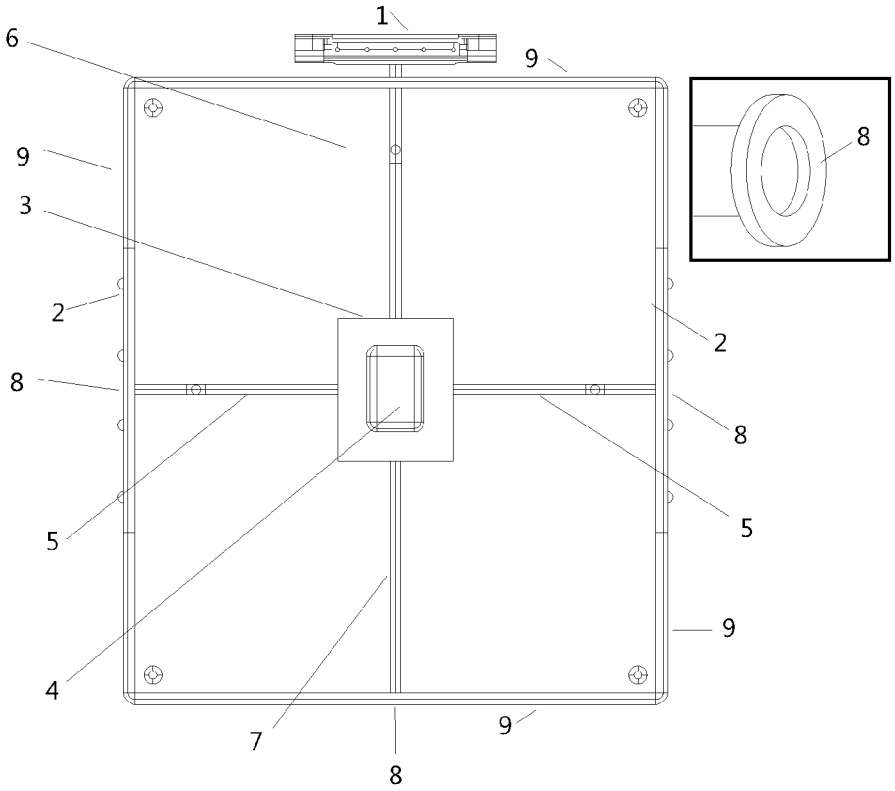

FIG. 3: is a plan view of the bedding straightening mechanism; invention shown in Drawings 1 and 2.

Figure 4:
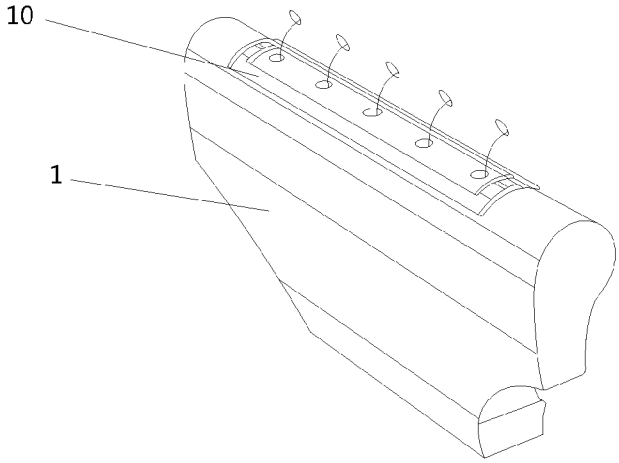

FIG. 4: is a perspective view of the central air distributor of the preferred embodiment of the invention showing the inflating hoses located at 45 degrees with respect to the total simultaneous length of bedding items (top sheet, blanket and bedspread).

Figure 1:
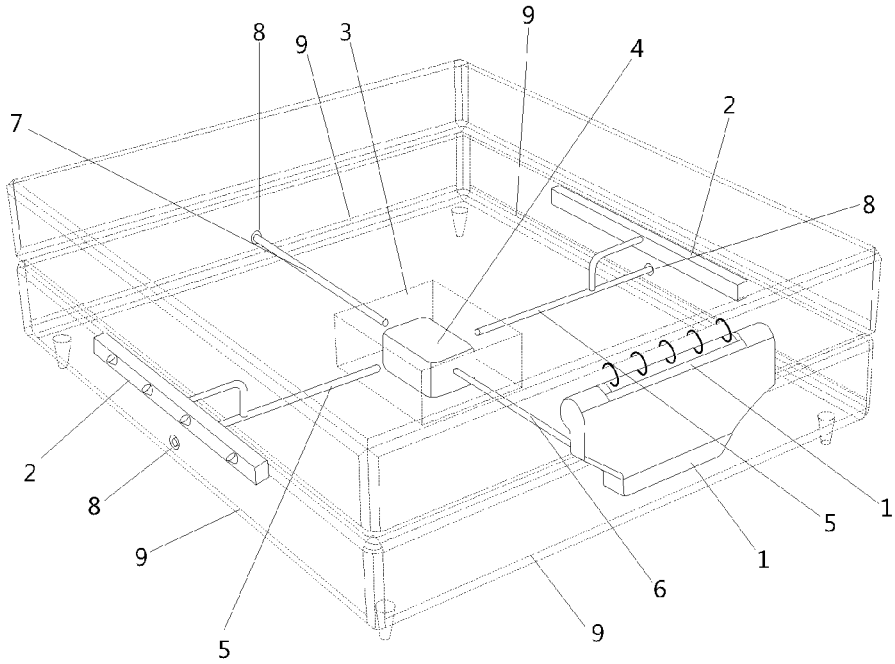
FIG. 1: Basic general perspective view of a conventional bed, equipped with the bedding straightening mechanism.
Figure 5:
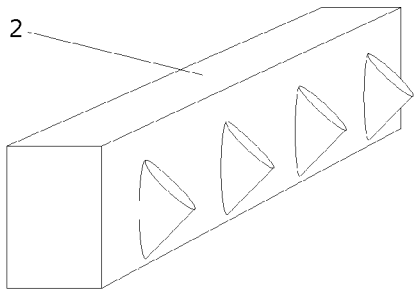

FIG. 5: depicts a perspective view of the lateral air distributor for inflating the bottom sheet FIG. 1.

Figure 6:
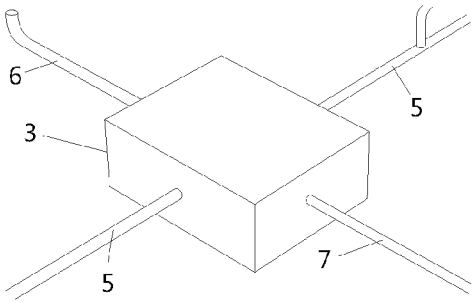

FIG. 6: depicts a perspective view of the sound proof box of FIG. 1.

Figure 7:
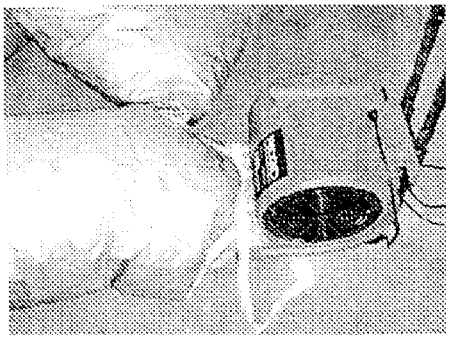

FIG. 7: depicts the turbine which provides air to distributors and connectors of FIGS. 1, 2 and 6.

Figure 8:
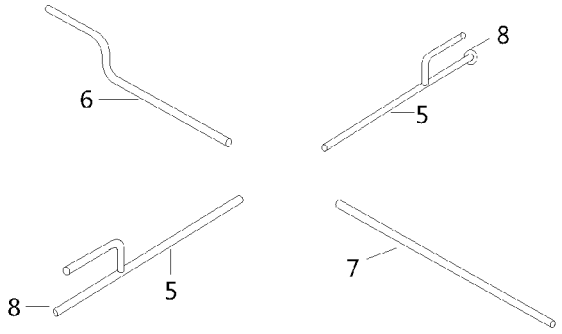

FIG. 8: Air conducting tubes of FIG. 1.

Figure 9:
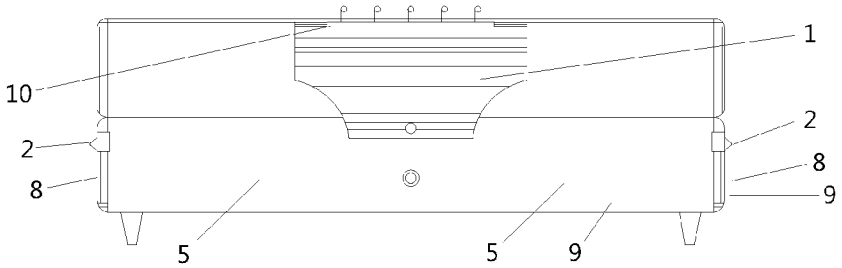

FIG. 9: Side view of the air conducting tubes for air distributors and inflating connectors of the bottom sheet FIG. 1.

Figure 10:
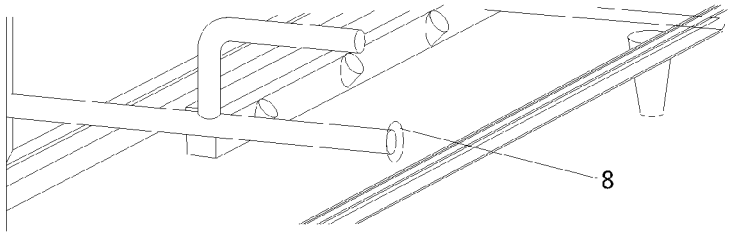

FIG. 10: Side view of the bottom sheet air chamber connector tube FIGS. 1 and 2.

Figure 11:
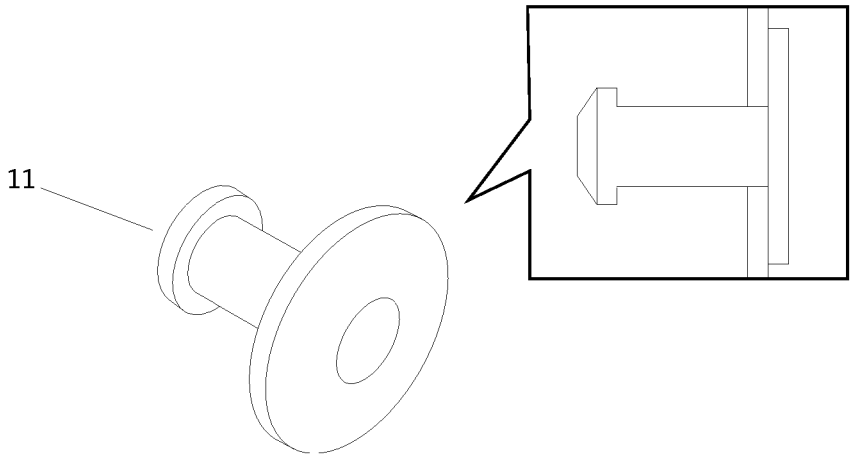

FIG. 11: Zoom view of the bottom sheet chamber connector which is inserted into the connector N° 8. FIG. 10.

N° 11: Bottom sheet connector which is inserted into the connector N° 8.

Figure 12:
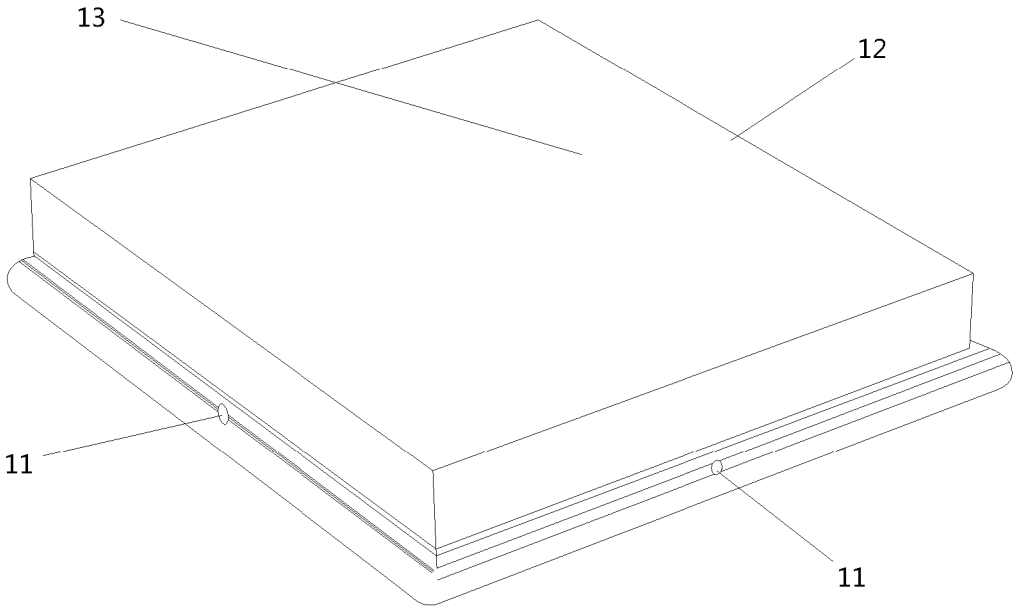

FIG. 12: Depicts a general view of the bottom sheet in which its chambers are inflated.

Figure 13:
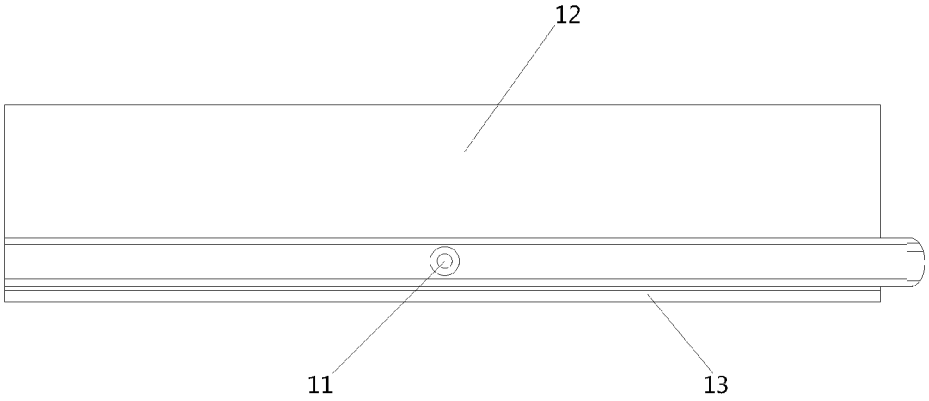

FIG. 13: Depicts a side view of the bottom sheet in which its chambers are inflated, showing the location of elastic system or fastening Velcros.

N° 13: Bottom sheet elastic system.

Figure 14:
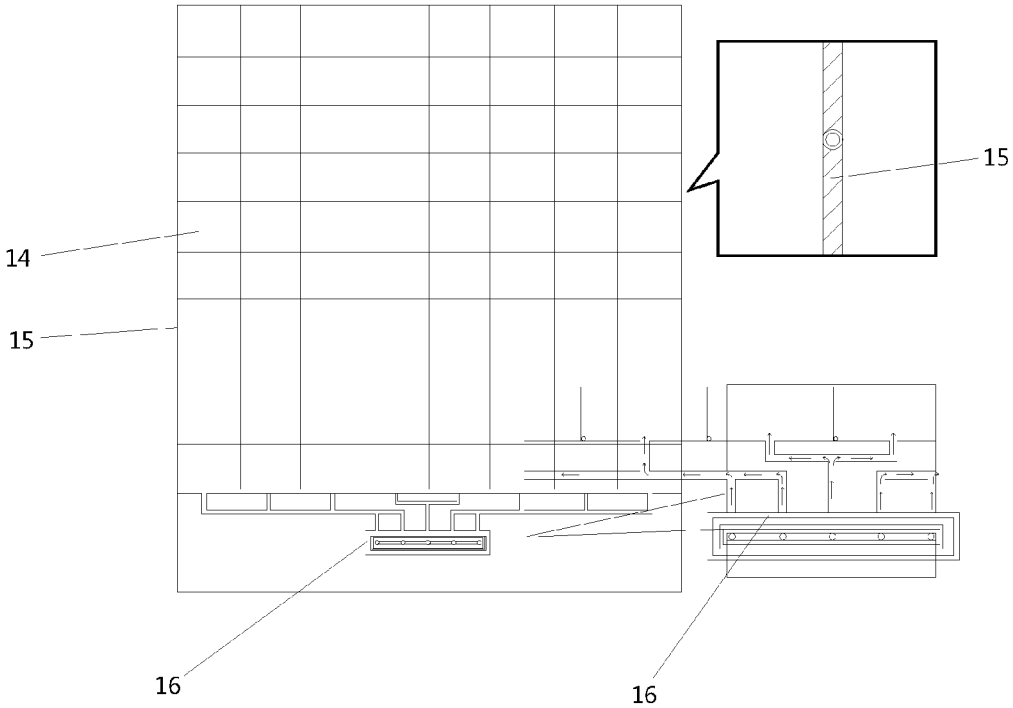

FIG. 14: Is a general view of the blankets showing the location of the fastening Velcros and inlet openings for central air distributor hoses. FIG. 4.

N° 14: Air chamber for inflating the top blanket.

N° 15: Snaps or fastening Velcro for blankets.

N° 16: Top blanket fastening Velcro to be attached to the central air distributor.

Figure 15:
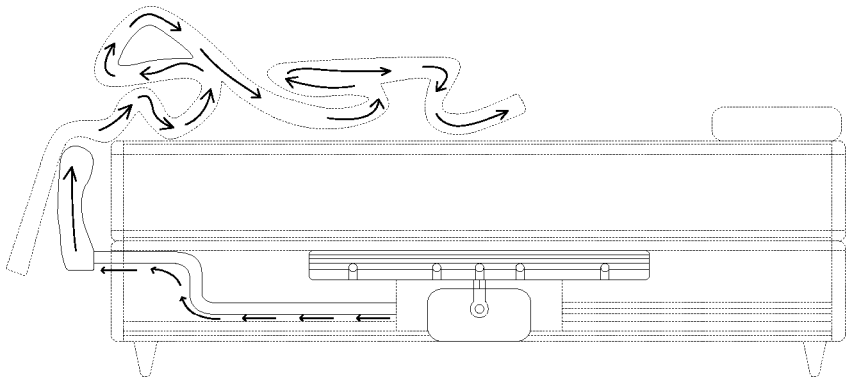

FIG. 15: A side view of an unmade bed. (Step I)

Figure 16:
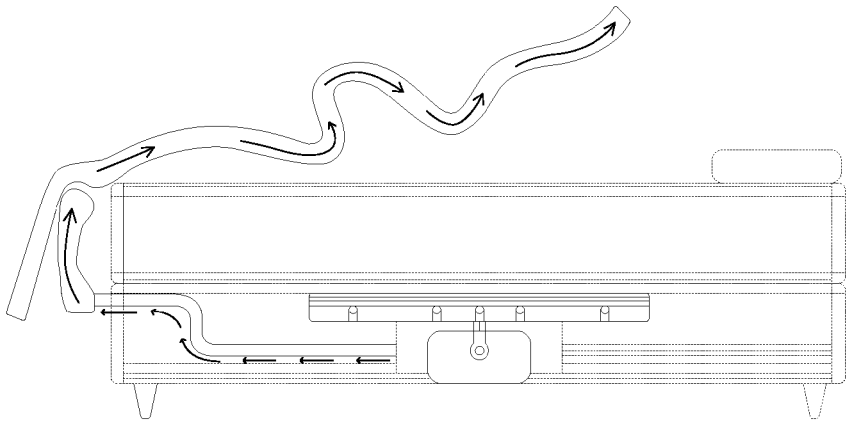

FIG. 16: Is a side view of the bedding straightening mechanism in its inflating process (Step II).

Figure 17:
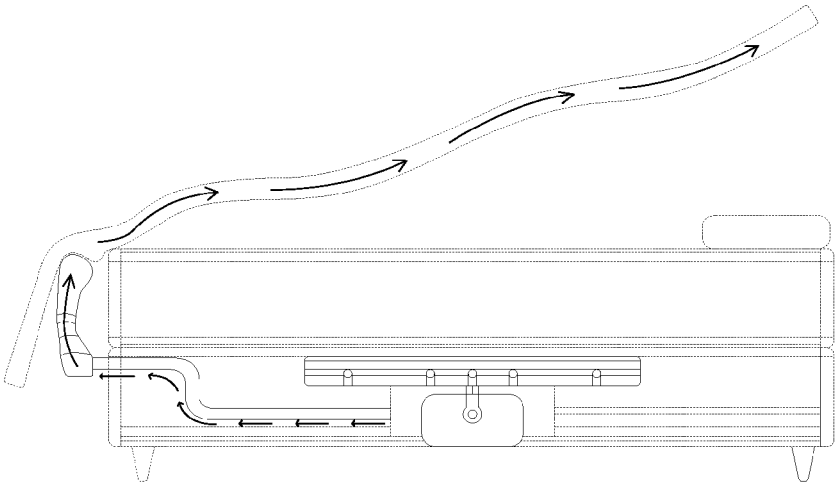

FIG. 17: Depicts almost the complete top bedding straightening (Top sheet, blanket and bedspread) (Step III).

Figure 18:
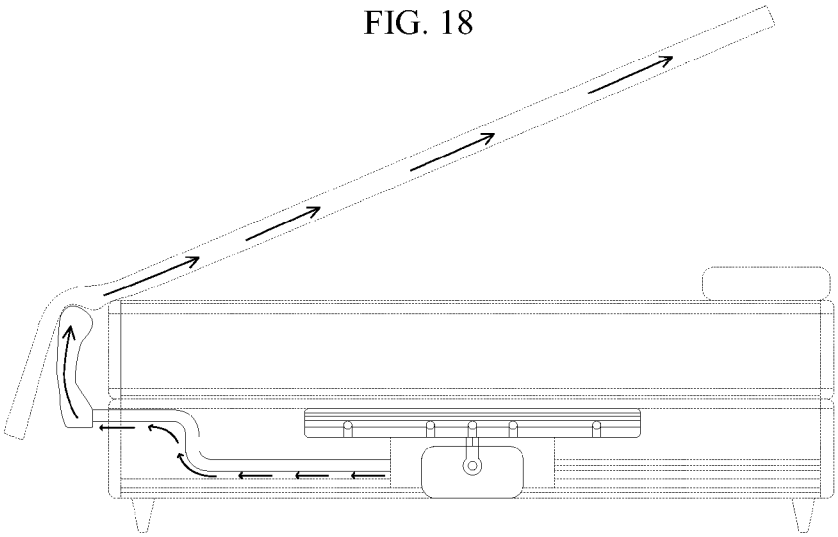

FIG. 18: Depicts the entire top bedding straightening (top sheet, blanket and bedspread) (Step IV).

Figure 19:
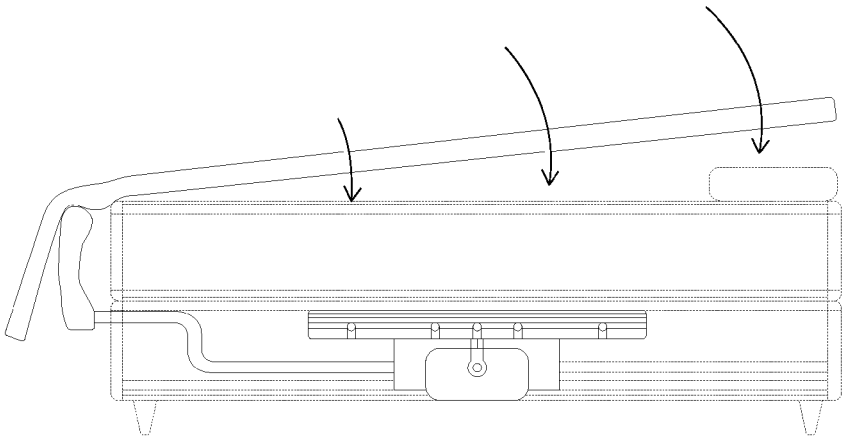

FIG. 19: Depicts the moments when the turbine is turned off where bedding items start to be placed gently on the bed (Step V).

Figure 20:
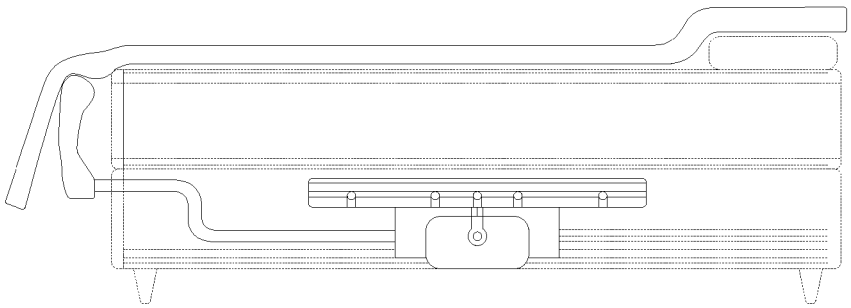
Figure 21:
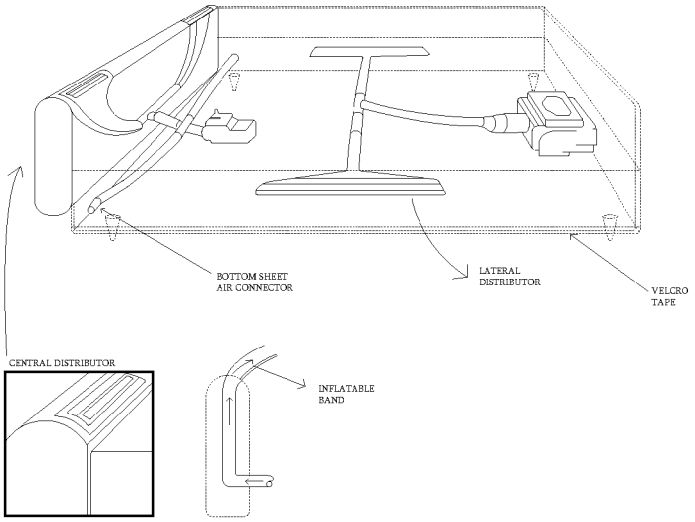
Figure 22:
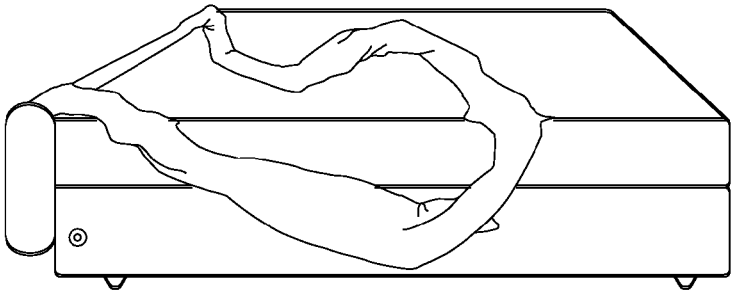
Figure 23:
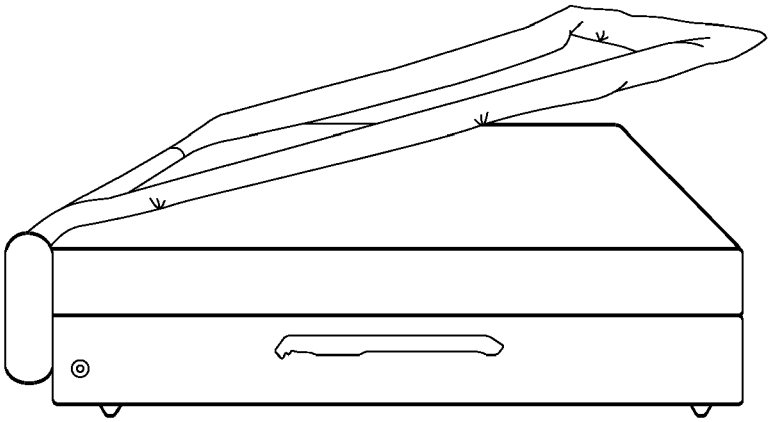
Figure 24:
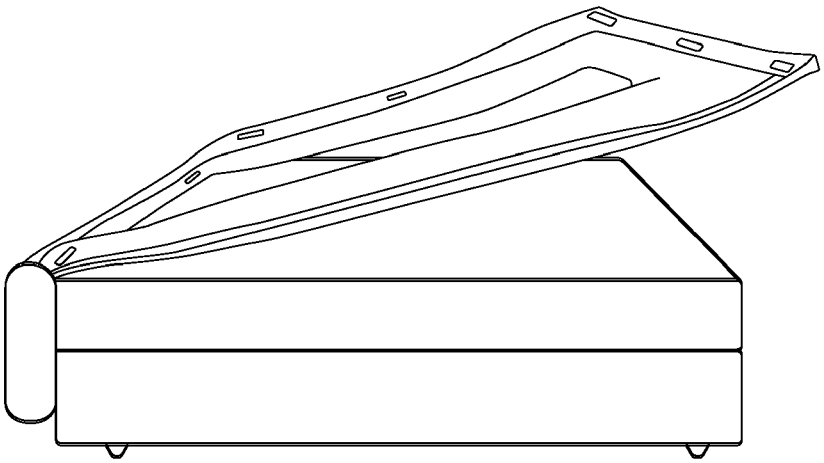
Figure 25:
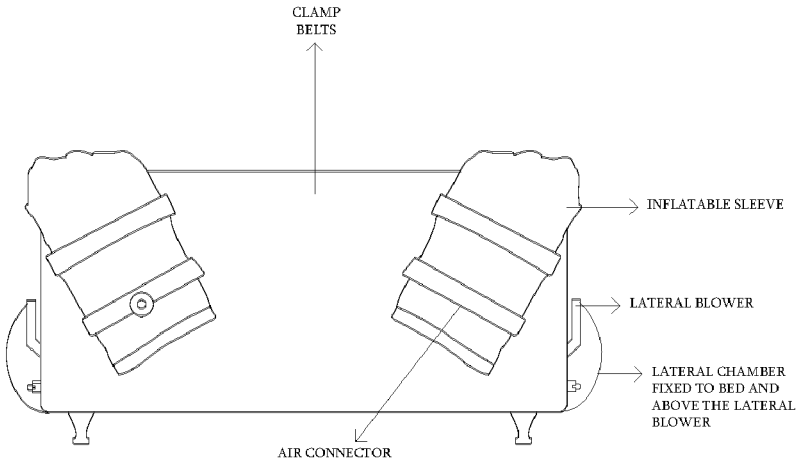
Figure 26:
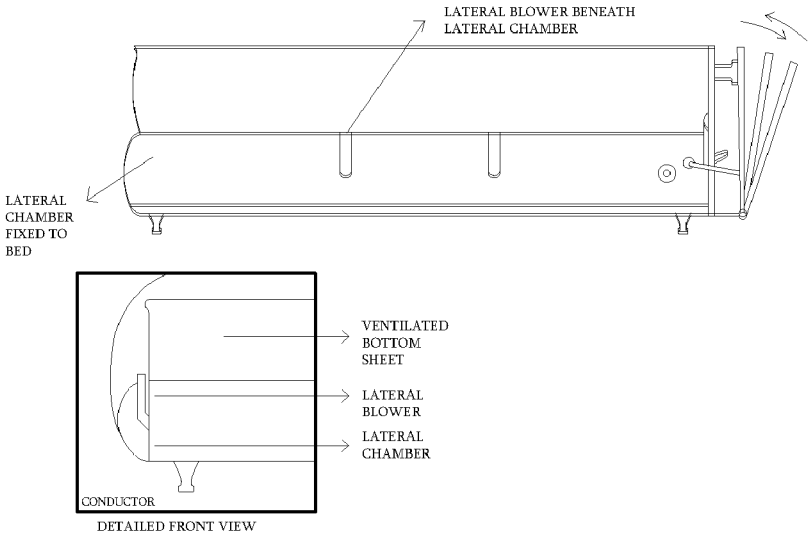
Figure 27:
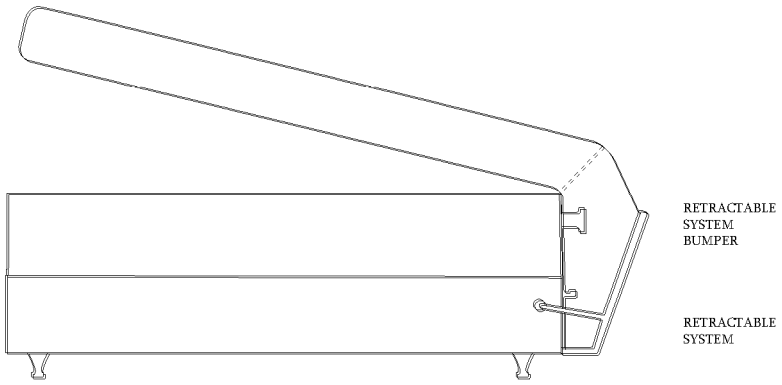

FIG. 20: End of bedding assembly process where bed clothing are placed in their correct position after being inflated (Step VI).

FIGS. 21-27: Figures of other embodiments of the application which are not drawn to scale.

DETAILED DESCRIPTION

Reference will now be made in greater detail to a preferred embodiment of the invention, an example of which is illustrated in the accompanying drawings. Wherever possible, the same reference numerals will be used throughout the drawings and the description to refer to the same or like parts.

As it is depicted in FIGS. 1 and 2, the bedding straightening mechanism is attached to the base of a conventional bed with its devices and driving command for bedding inflating. The location of the bedding straightening mechanisms can be seen in detail. Several air conducting ducts are attached to the lower part of the bed, protruding outwardly from sides and foot end of the bed to supply air to air distributors which regulate pressure thereof in order to achieve a correct inflation of the bed clothing specially designed for this function.

With regard to FIGS. 4 to 10, the bed straightening mechanism—according to a preferred embodiment of the present invention—consists of a small air expelling compressor or turbine FIG. 7, preferably sound proof, attached to air conducting ducts 6 and 8, connected to air distributors FIGS. 4, 5, 10 and 11, each projecting towards the especially designed blankets and sheets FIGS. 12, 13 and 14. In the present embodiment, the bottom sheet FIGS. 12 and 13, and blanket FIG. 14 are attached to the inflating connectors FIGS. 10, 11 and 12 which work together and independently, attached to the connectors of the bedding straightening mechanism which is fixed to the lower part of the bed. These mechanisms are especially useful in any kind of beds FIGS. 15 to 20. FIG. 18 is oriented in an inclined position with respect to the direction of the top blanket inflation (to produce the effect of an open oyster), in the end opposed to blanket connectors, small openings are located to allow gradual release of inflation air FIG. 19, enabling blankets to be placed on the mattress while they are kept straightened FIG. 20. The air is released faster at the upper end of the blanket which gradually flows from the inflating base, that is the one which is closer to the mattress and therefore, this area is placed first on the mattress.

In a preferred embodiment of the invention, the bottom sheet (12) is ventilated trough an individual turbine A, which makes the flow from turbine compressor B more efficient generating the necessary pressure to lift the upper bed clothing. However, such air flow from turbine compressor B is not enough to ventilate the sheets and therefore, the individual turbine A is dedicated exclusively to ventilation.

Regarding bottom sheet straightening sleeves, there is a preferred embodiment in which such bottom sheet is attached to the bed instead of being attached to the other sheets, as it is established in the aforementioned paragraphs. This will simplify the functions and components, washing process and manufacturing of the bottom sheet.

Additionally, in this preferred embodiment, the central air distributor has been replaced by two pressure ducts B and C which protrude from the base at the foot end of the bed, and which connect through fast pressure connections to the straightening sleeve of the top bed clothing. According to the same scheme, the top bedding straightening sleeve or ducts are being directed just by means of bands or belts which act as fastening clamps.

Regarding the foot end retractable cover, it is provided one which works with elements which help retrieve that cover or to make such cover retractable, elements such as elastics, springs or occasionally a hydraulic arm, which are used to compress the bedding straightening ducts to place them flat on the bed. In this way, space is saved when this system is not working, and thus when the bed mechanisms are activated, necessary space is generated for duct inflation at the time of functioning.

It is to be understood that the above-described embodiments are illustrative of only a few of the many possible specific embodiments, which can represent applications of the principles of the invention. Numerous and varied other arrangements can be readily devised in accordance with these principles by those skilled in the art without departing from the spirit and scope of the invention.

The invention claimed is:

1. Bedding straightening system to be attached to a base of a bed, berth, or hospital bed, which acts as a bedding automatic straightening device, requiring no human involvement, said system comprising an air compressor or air expelling turbine located inside a box:

a series of ducts or hoses which carry the air expelled from said air compressor or air expelling turbine towards different outlet points located around the perimeter of said bed, berth, or hospital bed, and connected to bedding by a blanket air distributor and bottom sheet side air distributors, said bedding including at least one bottom sheet and one bedspread; said at least one bottom sheet operating along with a tubular air chamber which crosses both lateral sides plus the back side of a bed mattress of said bed, birth, or hospital bed and when inflated produces tension on the at least one sheet causing the straightening thereof; and said bedspread including a structure of air chambers between two fabrics which when inflated cause the expansion and straightening of the bedspread, said bedspread including fixing means to attach additional bedding; and air outlets which protrude outwardly from the base of the bed, berth, or hospital bed through hoses disposed beneath said at least one bottom sheet in order to lift and ventilate the at least one bottom sheet.

2. The bedding straightening system according to claim 1, wherein said system further comprises an upper sheet which includes fixing means to enable the attachment of said upper sheet to said bedspread so as to allow a synchronized operation, thereby obtaining as a final result an automatic unfolding and straightening of said upper sheet and said bedspread.

3. The bedding straightening system according to claim 1, wherein said system further comprises at least one blanket which includes fixing means to enable the attachment to at least said bedspread so as to allow a synchronized operation, thereby obtaining as a final result an automatic unfolding and straightening of said at least one blanket and said bedspread.

4. The bedding straightening system according to claim 1, wherein said air chambers of said bedspread are provided as rectangular chambers distributed over said bedspread.

5. The bedding straightening system according to claim 1, wherein said air outlets are openings connecting said ducts or hoses to the bedding by said air distributors and the air chambers.

6. The bedding straightening system according to claim 1, further comprising an upper sheet and at least one blanket attached to said bedspread wherein the upper sheet, the at least one blanket and the bedspread are attached to the bed, berth, or hospital bed, by means of said air distributors and air chambers by hook and loop fasteners, pressure clasps or buttons.

7. The bedding straightening system according to claim 1, wherein the box is a soundproof box.

8. The bedding straightening system according to claim 2, wherein the fixing means is hook and loop fasteners or pressure clasps.

9. The bedding straightening system according to claim 3, wherein the fixing means is hook and loop fasteners or pressure clasps.

10. The bedding straightening system according to claim 4, wherein the rectangular chambers are distributed over the sides and lower edge of said bedspread.

* * * * *